250-505.1 SR
1/6/87 XR 4,634,873

United States Patent [19]
Bezer et al.

[11] Patent Number: 4,634,873
[45] Date of Patent: Jan. 6, 1987

[54] APPARATUS FOR FITTING A RADIOACTIVE SOURCE INTO A CYLINDRICAL RECESS

[75] Inventors: Christian Bezer, Savigny S/Orge; André Olombel, Briis s/s Forges; Georges Viel, Orsay, all of France

[73] Assignee: Commissariat a l'Energie Atomique, France

[21] Appl. No.: 691,067

[22] Filed: Jan. 14, 1985

[30] Foreign Application Priority Data

Jan. 20, 1984 [FR] France ..... 84 00880

[51] Int. Cl.[4] ..... G21F 5/00; G21F 5/02
[52] U.S. Cl. ..... 250/497.1; 250/506.1
[58] Field of Search ..... 250/496.1, 497.1, 506.1

[56] References Cited

U.S. PATENT DOCUMENTS 2,682,352 6/1954 Hawkins et al. ..... 250/506.1
4,066,909 1/1977 Bourdois et al. ..... 250/497.1
4,370,555 1/1983 Brethon et al. ..... 250/496.1
4,406,947 9/1983 Burton et al. ..... 250/497.1

*Primary Examiner*—Bruce C. Anderson
*Attorney, Agent, or Firm*—Cesari and McKenna

[57] ABSTRACT

In per se known manner, this apparatus comprises a radioactive source locked within a cylindrical source holder, which is itself fitted in an appropriate cylindrical recess. The cylindrical recess is higher than a larger diameter cylindrical recess, in whose walls are partly fitted at least one locking ring and at least one lug. The source holder has in its lower part a flange, whose upper portion is chamfered, as well as an annular groove and at least one slot, inclined with respect to the axis of revolution of the source holder and whose width is at least equal to the diameter of the said lug. This slot, which issues onto the upper face of the flange, is such that the position of the lug in the bottom of the slot corresponds to that of the locking ring in the annular groove. The apparatus has particular application to cobalt therapy equipment, particularly to the ALCYON head.

6 Claims, 7 Drawing Figures

APPARATUS FOR FITTING A RADIOACTIVE SOURCE INTO A CYLINDRICAL RECESS

BACKGROUND OF THE INVENTION

The present invention relates to an apparatus for fitting a radioactive source with the object of simplifying the fitting and removal operations of a radioactive source with respect to irradiation equipment. More specifically, the apparatus according to the invention has been designed for use in the head of an ALCYON-type cobalt therapy means.

The invention also relates to an apparatus permitting the in situ repair of cobalt therapy heads of the same type.

According to the prior art, irradiation equipment using radioactive sources are subject to the requirement of fitting such sources and the changing thereof when the radioactive decay has become excessive, e.g. a few years in the case of $^{60}CO$. The extremely high activity prevailing in contact with the source and in the vicinity thereof makes such operations more difficult. Thus, these operations must either be carried out in shielded cells with expansion tongs, or in appropriate lead-shielded flasks or caskets.

In per se known manner, such apparatus comprise a radioactive source, complying with an approved model, which is externally shaped like a cylinder, which must not be modified prior to the filling by the active material, for adding anchoring devices or screw threads. This type of source is introduced into a cylindrical recess, in which it is then fixed by various means.

In a first embodiment, the source is fitted on a sliding valve sliding in a cobalt therapy installation and fixed in its recess or housing by a screw.

In another known embodiment, the source is fitted on a drum in an ALCYON-type irradiator and is fixed in its recess by circlips. These two embodiments suffer from various disadvantages, in that they are subject to difficulties during the installation or removal of the source with respect to an irradiator, particularly when it is a question of fitting or detaching a circlip relative to a shielded enclosure and using expansion tongs.

SUMMARY OF THE INVENTION

The present invention relates to an apparatus for fitting a radioactive source, which obviates such disadvantages and in particular brings about a simplified installation or extraction. Thus, the source is introduced into a source holder constructed so as to lock the same in a very simple manner, without disturbing the exit of the radiation beam. This source holder is then itself introduced into an appropriate recess of the irradiator.

This apparatus, of the type incorporating a radioactive source locked within a cylindrical source holder, itself fitted in an appropriate cylindrical recess, is characterized in that the cylindrical recess is higher than a larger diameter cylindrical recess in the walls of which are partly fitted at least one locking ring and at least one lug and wherein the source holder has in its lower part a flange, which is chamfered in its upper part, having an annular groove for receiving the unfitted part of the locking ring, and at least one slot which slopes with respect to the axis of revolution of the source holder and whose width is at least equal to the diameter of said lug, issuing onto the upper face of said flange, the slot ensuring the guidance of the lug in such a way that the position of the lug in the bottom of the slot corresponds to that of the locking ring in the annular groove.

According to another feature of the invention, the apparatus for fitting a radioactive source into a cylindrical recess is characterized in that at the upper end of the source holder are provided fold-back metal tongues, which ensure the locking of said source in said source holder.

According to another feature of the invention, the apparatus for fitting a radioactive source in a cylindrical recess is characterized in that at its bottom, the source holder has a groove for receiving the ends of the fingers of an especially adapted tool, particularly in the form of tongs having two fingers, by means of which the source holder is introduced into the appropriate cylindrical recess.

According to another feature of the invention, the apparatus for fitting a radioactive source into a cylindrical recess is characterized in that it has means for permitting the transfer of the source holder containing the radioactive source from its cylindrical recess to a flask, which in particular has a storage passage.

The term flask is understood to mean throughout the present text a shielded means used for the provisional housing of the source during any intervention on the irradiator head requiring the withdrawal of said source.

BRIEF DESCRIPTION OF THE DRAWINGS

The invention is described in greater detail hereinafter relative to non-limitative embodiments and with reference to the attached drawings, wherein show:

FIG. 1 illustrates a procedure for fixing the source in its recess by screws, while FIG. 2 illustrates a procedure for fixing the source in its recess by circlips.

DETAILED DESCRIPTION OF THE INVENTION

Figure 1:
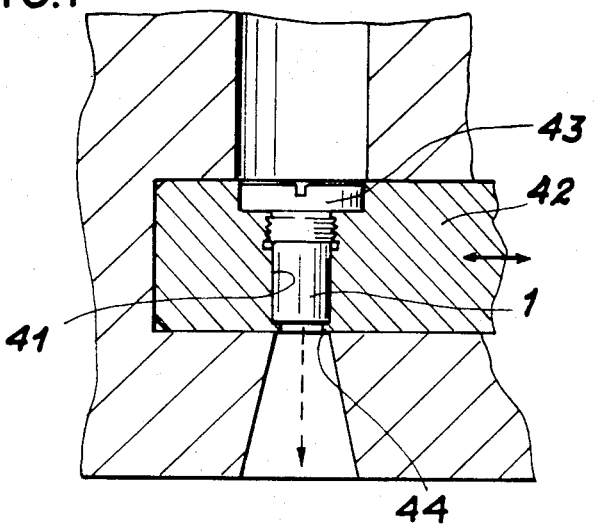
FIG.1 PRIOR ART
FIGS. 1 and 2 which are vertical sectional views illustrating two embodiments according to the prior art and which are presently used, whereby
Figure 2:
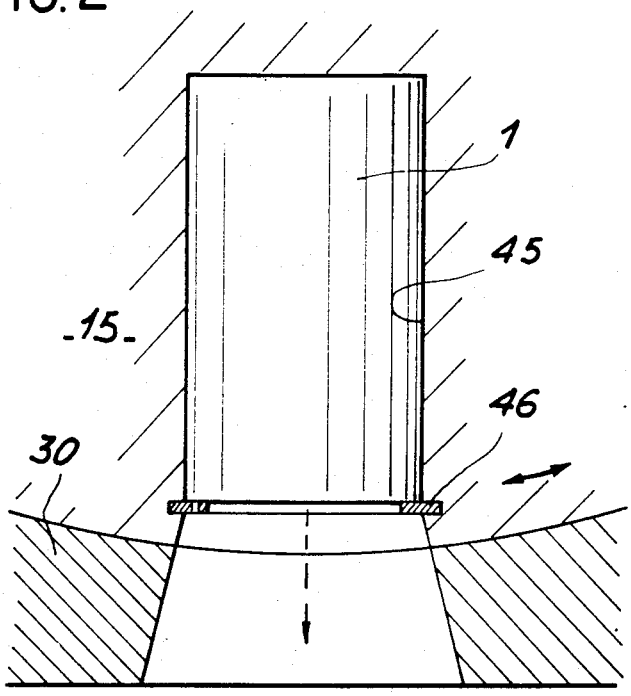
FIG.2 PRIOR ART

Two prior art embodiments of the fitting of a radioactive source in an appropriate recess have been given. In FIG. 1, the source 1 is fitted in a recess 41 on a sliding valve 42 in a cobalt therapy installation. It rests on an annular shoulder 44, located in the lower part of recess 41, in such a way that it does not impede the exit of the radiation beam from source 1, the latter being fixed by a screw 43 in the recess 41. In the case of FIG. 2, source 1 is fitted in a recess 45 on a drum 15 in the head 30 of an ALCYON-type irradiator, it being fixed in its recess by a circlip 46.

These two embodiments show the difficulties which can be encountered during the fitting and removal of a source with respect to an irradiator according to the prior art, particularly during the fitting or removal of a circlip or screw with respect to a shielded container and using expansion tongs.

Such inconveniences are obviated by the present invention by eliminating any fixing means of the circlip or screw type.

Figure 3:
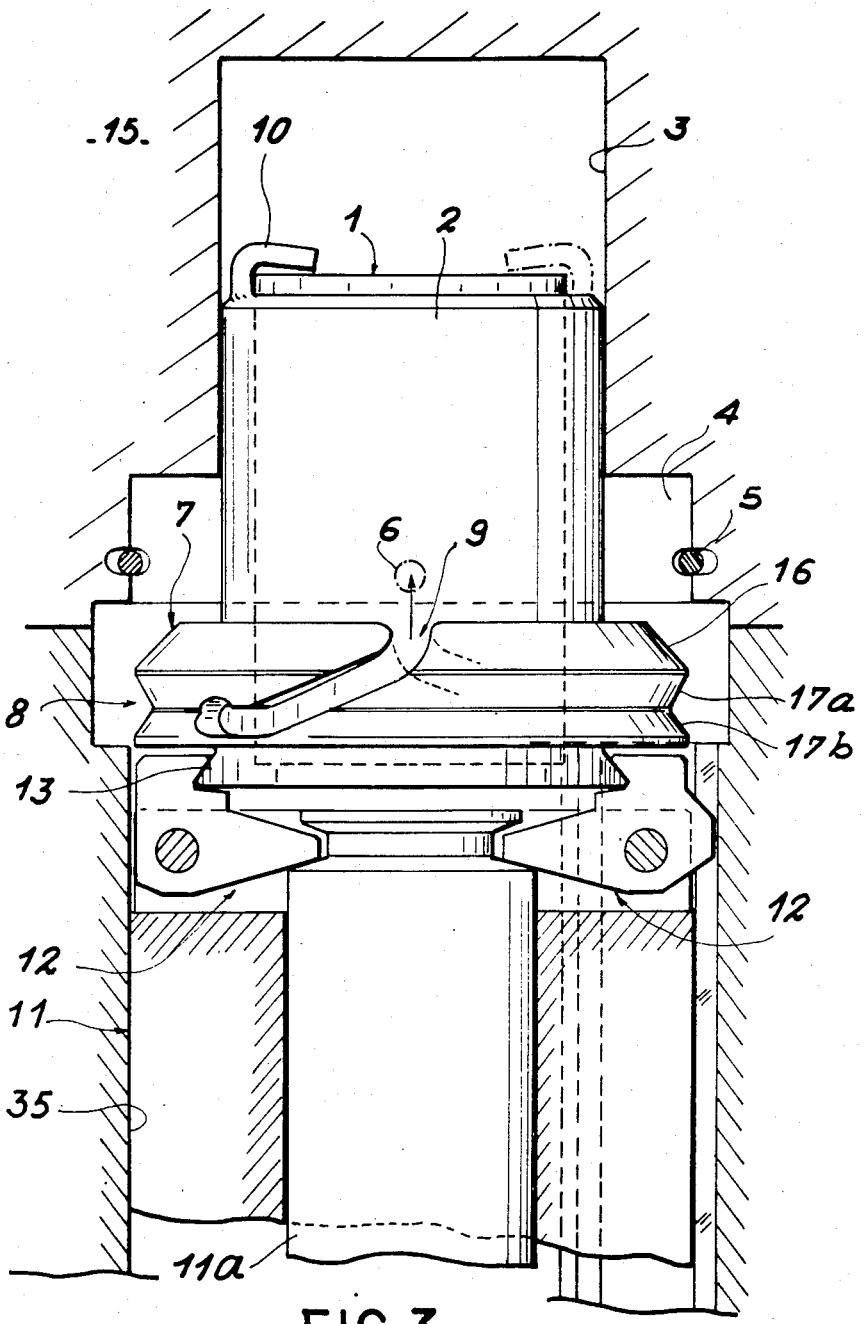
FIGS. 3 and 4 which are vertical sectional views representing respectively the introduction and fitting of the source holder in an appropriate cylindrical recess according to the invention.
Figure 4:
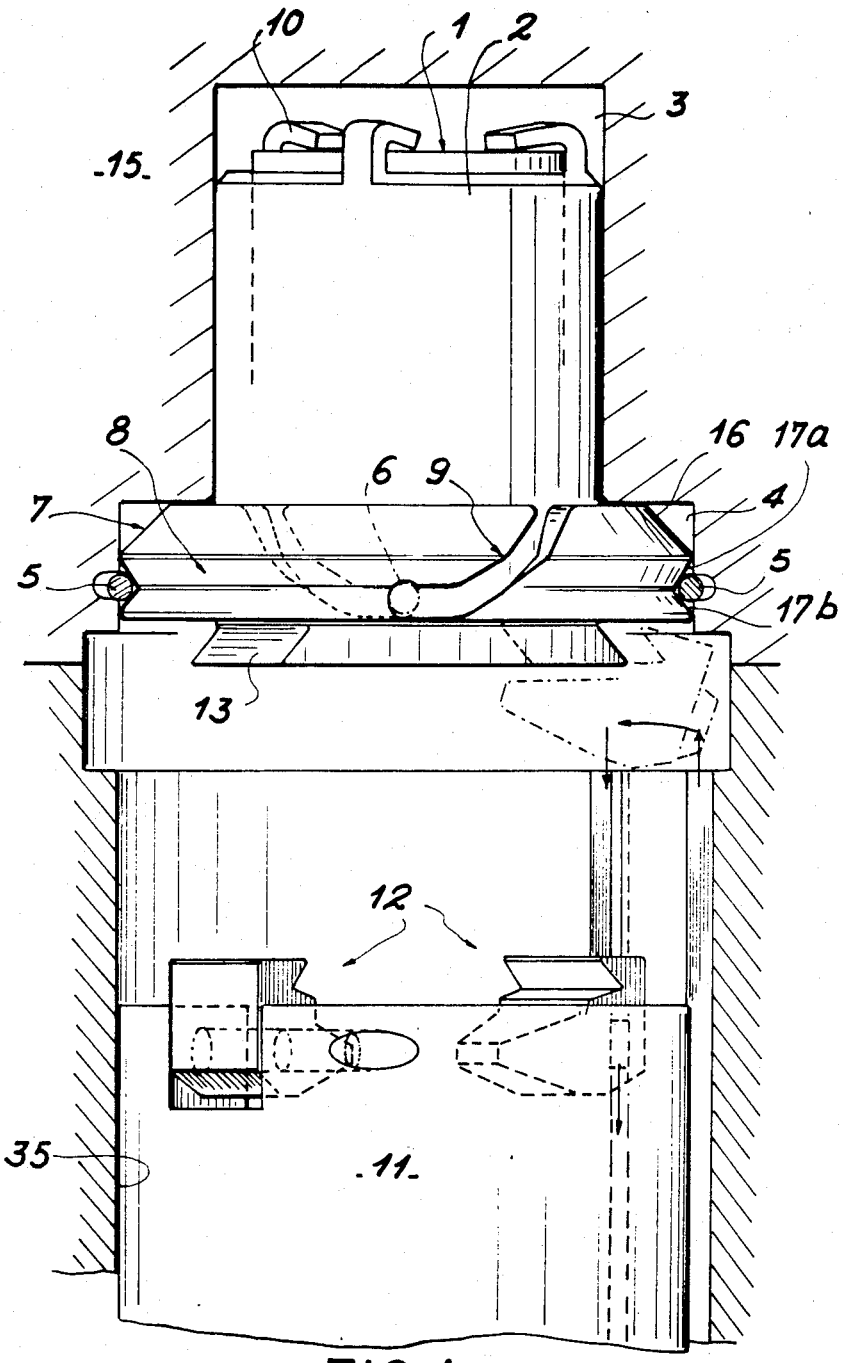

FIGS. 3 and 4 show the radioactive source which, according to an approved model, is externally shaped like a cylinder, which must not be modified prior to the filling with the active material, for adding anchoring devices, screw threads, etc.

This radioactive source 1 is introduced into a metal cylindrical envelope, i.e. the source holder 2 and is locked in the latter by turning down three metal tongues 10, located in the upper part thereof. The source holder 2 is itself fitted to a drum 15 of the type contained in the ALCYON irradiator head, within an appropriate cylindrical recess 3, which is higher than a larger diameter second cylindrical recess 4.

Partly fitted in the walls of recess 4 are two diametrically opposite, piano wire locking rings 5 and two diametrically opposite lugs 6, which are arranged perpendicularly with respect to the locking rings 5.

The lower part of source holder 2 has a flange 7, which is chamfered in its upper part 16 and whose cylindrical surface of revolution has a V-shaped annular groove 8 formed by two symmetrical chamfers (17*a, b*). It also has two diametrically opposite slots 9, which issue above said flange 7. These slots 9 slope with respect to the axis of revolution of source holder 2 and their width is at least equal to the diameter of a lug 6.

Finally, at the base of source holder 2 there is a circular groove 3, on which are closed the ends of two articulated fingers 12 controlled by the manipulating rod 11*a* of a tong-like tool 11.

The apparatus for fitting a radioactive source in an appropriate cylindrical recess according to the invention functions in the following manner. The source holder 2 is gripped by tongs 11 and which for this purpose are constructed as tongs with two fingers 12, by means of the circular groove 13, after which it is introduced in the manner of an electric light bulb into its socket into the appropriate cylindrical recess 3 of drum 15.

When source holder 2 is rotated, as a result of a significant lever action, it exerts a considerable force in the sense of driving the source holder 2 into recess 3. This force enables the chamfer 16 to move apart the locking rings 5, which are then introduced into the annular groove 8. Simultaneously, lugs 6 reach the bottom of slots 9 (cf FIG. 4), so that there is a total immobilization of the assembly.

In order to extract the source holder 2 from recess 3, it is reversed in the opposite direction to the previous rotation with the aid of tool 11. This rotation produces a force in the opposite direction to the previous force, which acts on the upper chamfer 17*a* of groove 8, said chamfer 17*a* moving apart the locking rings 5 and permitting the extraction of source holder 2.

Thus, the positioning of source holder 2 in its recess 3 is identical to that of the base of a bayonet-type electric light bulb in the corresponding socket, with the exception that the bayonets (lugs 6) are located on recess 4 of source holder 2 and the slots 9 on source holder 2.

Moreover, the immobilization of source holder 2 with the aid of two locking rings 5 located in the annular groove 8 permits a permanent locking in recess 4 of drum 15.

A design of this type has the advantage of simplifying the manufacture of the apparatus for fitting a radioactive source in an appropriate recess according to the invention. It also has the advantage of facilitating the fitting and removal of the source with respect to an irradiator, or any other device having a radioactive source.

Thus, in the case of a mechanical breakdown of an irradiator, particularly an ALCYON-type irradiation source, the apparatus for the fitting or extraction of a radioactive source with respect to an appropriate recess according to the invention permits the simple transfer of source 1 to a flask 20.

Figure 5:
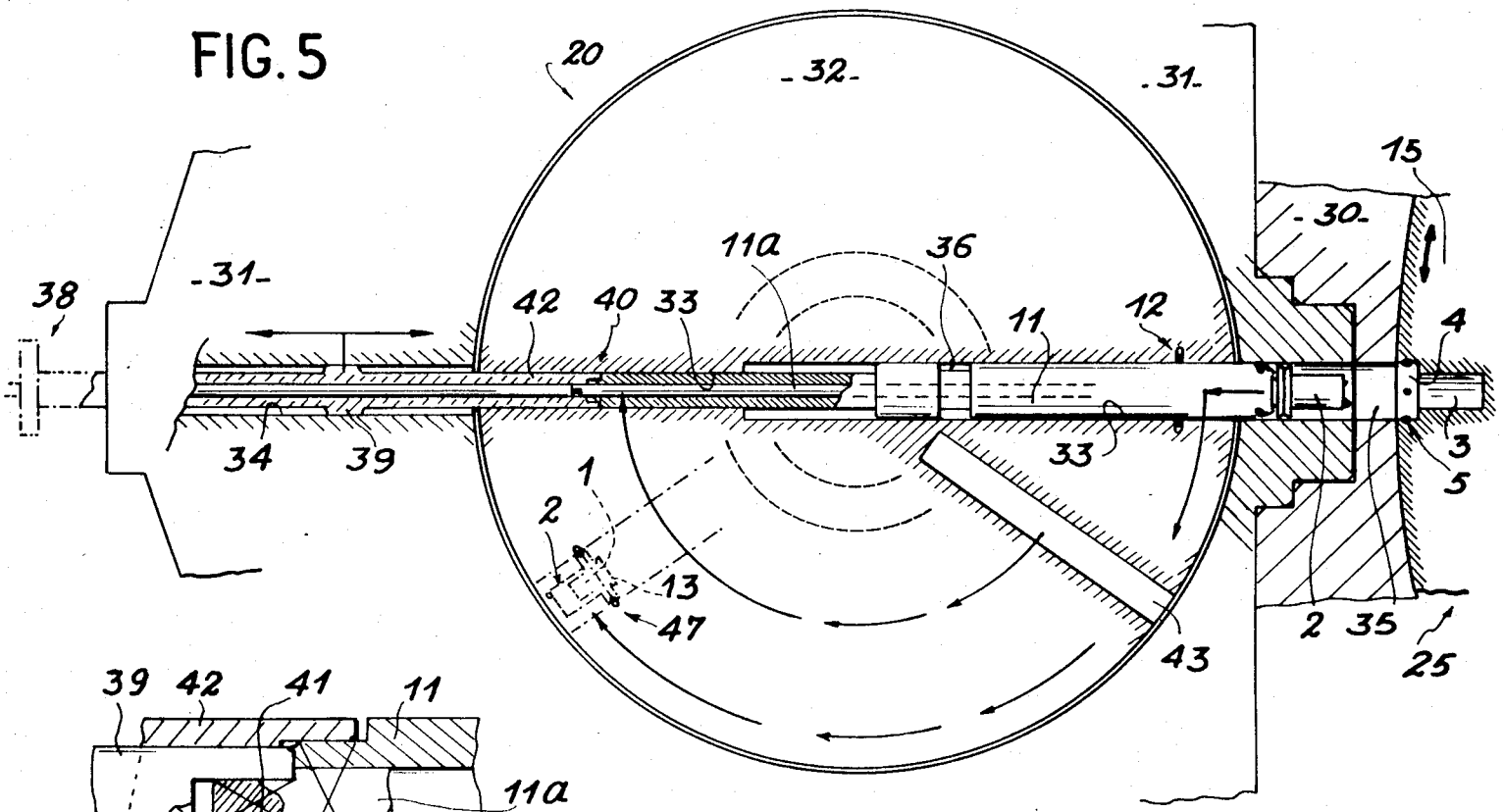
FIGS. 5*a* and 6 which are diagrammatic plan and vertical sectional views illustrating, more particularly in the case of a mechanical fault on the irradiator, the transfer of the radioactive source to a flask.
Figure 6:
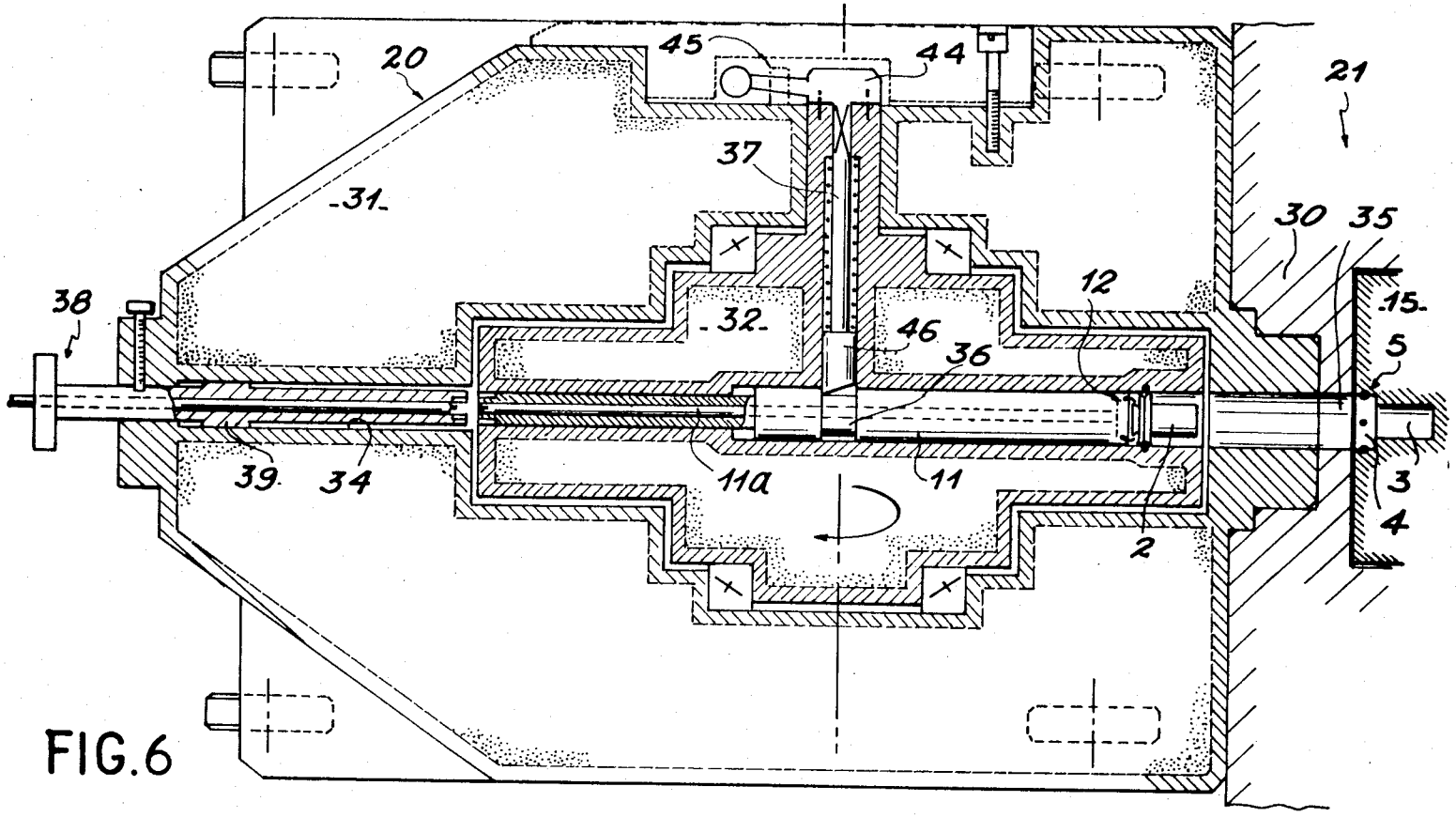

FIGS. 5 and 6 show in plan view and elevation, the flask 20 in its position associated with an ALCYON-type irradiator 20, whereof it is possible to see the body 30 and the drum 15 containing the recess 3 of source holder 2. The flask 20 has an external shielding zone 31 and a central drum 32, which is provided with a transverse passage 33, which can be aligned with the passages 34 of shielding means 31, 35 of the head of irradiator 21.

The tong-like tool 11 is located in passage 33 and has a groove 36 which faces the control rod 37 of drum 32 (FIG. 6), when the source holder 2 is located in said same drum 32.

A control 38 makes it possible to act across shielding 31 of tool 11 for the translation and locking in rotation of source holder 2 in its recess 3. For this purpose, transmission means 39 for said control 38 are located in passage 34 and are connected at 40 to the end of tool 11 opposite to irradiator 21.

Figure 5A:
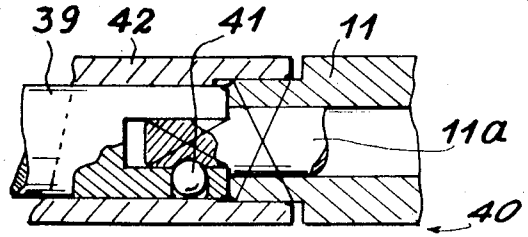

The connection details are visible from FIG. 5*a*, where it is possible to see a locking ball 41 maintained in its recess by an external jacket 42 permitting the locking in translation and rotation of control 39 and tool 11.

Drum 32 also has a radial cylindrical recess 43 which, by rotation, can become aligned with passage 34 and which can receive the transmission rod 39 moved by control 38 and serving to immobilize drum 32 in rotation.

FIG. 6 more particularly shows the rotation control rod 37 of drum 32 comprising a control head 44 which can be locked by a padlocking system 45 and a profiled end 46 for entering the groove 39 of tool 11 and for immobilizing the latter in rotation.

Source holder 2 is transferred to drum 32 in the following way. Initially, the radioactive source 1 contained in the source holder 2 is located in the drum 15 of the ALCYON-type, irradiator head 30. Head 30 is assembled with flask 20 so as to align passage 35 with passage 33 of the flask 20. By rotating drum 15, the source holder is made to face the intake of passage 33 of drum 32. By manipulating control 38, the transmission means 39 are coupled with tool 11 and the source holder 2 is gripped with the aid of the fingers 12 of tool 11 (FIG. 5). It is withdrawn from irradiator 30 and brought into the position of FIG. 6, where it is locked in translation by the engagement of end 46 in groove 36. In this position, the tool 11 occupies the entire diameter of the drum and the transmission means 39, which are disconnected from the tool, are retracted into the shielding 31, thus permitting the free rotation of drum 32 with the aid of rod 37. Drum 32 is then rotated in its shielding 31 until the cylindrical recess 43 is brought into the extension of passage 34, which leads to the placing of source holder 2 in the storage position 47 indicated by broken lines in FIG. 5. The drum 32 is immobilized in rotation by introducing, with the aid of control 38, transmission means 39 into the cylindrical recess 43, followed by the locking of padlock 45.

The reintroduction of the source, particularly after a repair has taken place, is carried out by reversing the order of the aforementioned stages.

This type of transfer has the advantage in the case of a mechanical breakdown of the irradiator of permitting difficult repairs to take place, which may even be impossible when the source is present and which hitherto required the return of the ALCYON head to the test center in a shielded cell prior to any discharge.

Obviously, this type of transfer is not limited to the embodiment specifically described and represented and numerous variants are possible thereto without passing beyond the scope of the invention.

What is claimed is:

1. An apparatus for fitting into a cylindrical recess a radioactive source locked within a cylindrical source holder, wherein the cylindrical recess is higher than a larger diameter cylindrical recess in the walls of which are partly fitted at least one locking ring and at least one lug and wherein the source holder has in its lower part a flange, which is chamfered in its upper part, having an annular groove for receiving the unfitted part of the locking ring, and at least one slot which slopes with respect to the axis of revolution of the source holder and whose width is at least equal to the diameter of said lug, issuing onto the upper face of said flange, the slot ensuring the guidance of the lug in such a way that the position of the lug in the bottom of the slot corresponds to that of the locking ring in the annular groove.

2. An apparatus for fitting a radioactive source into a cylindrical recess according to claim 1, wherein the source holder has at its upper end metal tongues which can be folded down and which ensure the locking of the source in the source holder.

3. An apparatus for fitting a radioactive source into a cylindrical recess according to claim 1, wherein it comprises an especially adapted tool in the form of tongs with two fingers permitting the introduction of the source holder into the appropriate cylindrical recess.

4. An apparatus for fitting a radioactive source into a cylindrical recess according to claim 3, wherein the source holder has a cylindrical groove at its bottom and which serves to receive the fingers of the tool.

5. An apparatus for fitting a radioactive source in a cylindrical recess according to claim 1, wherein the annular groove made in the flange is V-shaped.

6. An apparatus according to claim 1, wherein it is associated with a flask having a central drum mounted in rotary manner in shielding with the aid of a control rod, said central drum having a diametral passage for housing the source holder gripping tool and, angularly displaced with respect to the passage, a radial cylindrical recess which can be aligned with a passage traversing the shielding while extending the passage of the irradiator head, said passage permitting the introduction of transmission means for the tool controls.

* * * * *